US006039552A

United States Patent [19]

Mimura

[11] Patent Number: 6,039,552

[45] Date of Patent: Mar. 21, 2000

[54] ROTARY COMPRESSOR

[76] Inventor: Kenji Mimura, 29-1105, Wakabadai 4-chome, Asahi-ku, Yokohama-shi, Kanagawa 241-0801, Japan

[21] Appl. No.: 09/036,786

[22] Filed: Mar. 9, 1998

[30] Foreign Application Priority Data

Mar. 11, 1997 [JP] Japan ..... 9-055797

[51] Int. Cl.[7] ..... F01C 1/10

[52] U.S. Cl. ..... 418/166; 418/164; 418/171

[58] Field of Search ..... 418/171, 166

[56] References Cited

U.S. PATENT DOCUMENTS

| | | | |
|---|---|---|---|
| 3,847,123 | 11/1974 | Vierling | 418/166 |
| 4,125,031 | 11/1978 | Swain | 418/166 |
| 5,658,138 | 8/1997 | Round et al. | 418/171 |
| 5,720,251 | 2/1998 | Round et al. | 418/171 |

FOREIGN PATENT DOCUMENTS

| | | | |
|---|---|---|---|
| 672398 | 12/1929 | France | 418/171 |
| 59-181284 | 12/1984 | Japan . | |
| 0080085 | 4/1988 | Japan | 418/171 |
| 396857 | 9/1933 | United Kingdom | 418/171 |

*Primary Examiner*—Thomas Denion
*Assistant Examiner*—Thai-Ba Trieu
*Attorney, Agent, or Firm*—Lowe Hauptman Gopstein Gilman & Berner

[57] ABSTRACT

The present invention provides a rotary compressor capable of significantly reducing the loss attributable to mechanical friction. Since an outer rotor 2 is connected via connecting plates 4 to an inner rotor 3, when the outer rotor 2 is rotated by external rotational force, the inner rotor 3 can rotate together with the outer rotor 2 in the same direction. At that time, the rotors 2 and 3 rotate at positions offset relative to each other so that partition pieces 2*d* on the outer rotor 2 perform circular movement within partition grooves 3*b* in the inner rotor 3 while turning the connecting plates 4. Thus, the rotors 2 and 3 rotate together, with at least two partition pieces 2*d* turning all the time along the inner surfaces of the associated partition grooves 3*b* in a non-contact manner, so that a fluid from an inflow port 1*d* flows into a space between the rotors 2 and 3 partitioned by the partition pieces 2*d* and the partition grooves 3*b*, the fluid being discharged through an outflow port 1*e*.

5 Claims, 8 Drawing Sheets

ROTARY COMPRESSOR

BACKGROUND OF THE INVENTION

1. Field of the Invention

The present invention relates to a rotary compressor for compressing various types of fluids, for use as pumps or superchargers for internal combustion engines.

2. Description of the Related Art

Such a rotary compressor hitherto known comprises, as described in, e.g., Japanese Utility Model Registration Laid-open Publication No. 59-181284, a casing having an inflow port and an outflow port for a fluid which open on its inner surface, a cylindrical outer rotor rotatably housed in the casing, a cylindrical inner rotor rotatably supported at an eccentric position within the outer rotor, and a plurality of vanes slidably attached, in the radial direction, to grooves formed in the outer peripheral surface of the inner rotor, wherein a fluid is sucked through the inflow port of the casing into a space between the outer rotor and the inner rotor partitioned by the vanes, the fluid being discharged through the outflow port of the casing.

However, due to the structure of the conventional rotary compressor in which the tips of the vanes whirl in contact with the inner peripheral surface of the outer rotor, the loss attributable to mechanical friction is significant, making difficult the use in high-speed rotations, as in the case of use as, e.g., an automobile supercharger.

SUMMARY OF THE INVENTION

The present invention was conceived in view of the above problems. It is therefore an object of the present invention to provide a rotary compressor capable of significantly reducing the loss attributable to mechanical friction.

According to an aspect of the present invention, there is provided a rotary compressor comprising a casing having an inflow port and an outflow port for a fluid which open on its inner surface, a cylindrical outer rotor rotatably housed in the casing, and a cylindrical inner rotor rotatably supported at an eccentric position within the outer rotor, the rotors being rotated in a predetermined direction to introduce the fluid from the inflow port into a space between the rotors, the fluid being discharged through the outflow port, the improvement wherein the outer rotor has an inner peripheral surface provided with one or more protruding portions for partitioning which are radially inwardly raised and are circumferentially spaced apart from one another; and the inner rotor has an outer peripheral surface provided with one or more recessed portions for partitioning which are radially inwardly recessed and are circumferentially spaced apart from one another; and wherein the outer rotor and the inner rotor are connected to each other in such a manner that the protruding portions for partitioning of the outer rotor move circularly in a non-contact manner along inner surfaces of the recessed portions for partitioning of the inner rotor.

According to the present invention, rotations of the rotors allow a non-contact circular movement of the protruding portions for partitioning of the outer rotor along the inner surfaces of the recessed portions for partitioning of the inner rotor, with the result that a fluid from the inflow port is sucked into a space between the rotors partitioned by the protruding portions and the recessed portions for partitioning, the fluid being discharged through the outflow port. Thus, the loss arising from mechanical friction is reduced to a large extent, making it possible to deal with the use in high-speed rotations, which is extremely advantageous to, e.g., superchargers for internal combustion engines.

BRIEF DESCRIPTION OF THE DRAWINGS

The above and other aspects, objects, advantages and features of the present invention will become more apparent from the following detailed description with reference to the accompanying drawings, in which.

DESCRIPTION OF THE PREFERRED EMBODIMENTS

Figure 1:
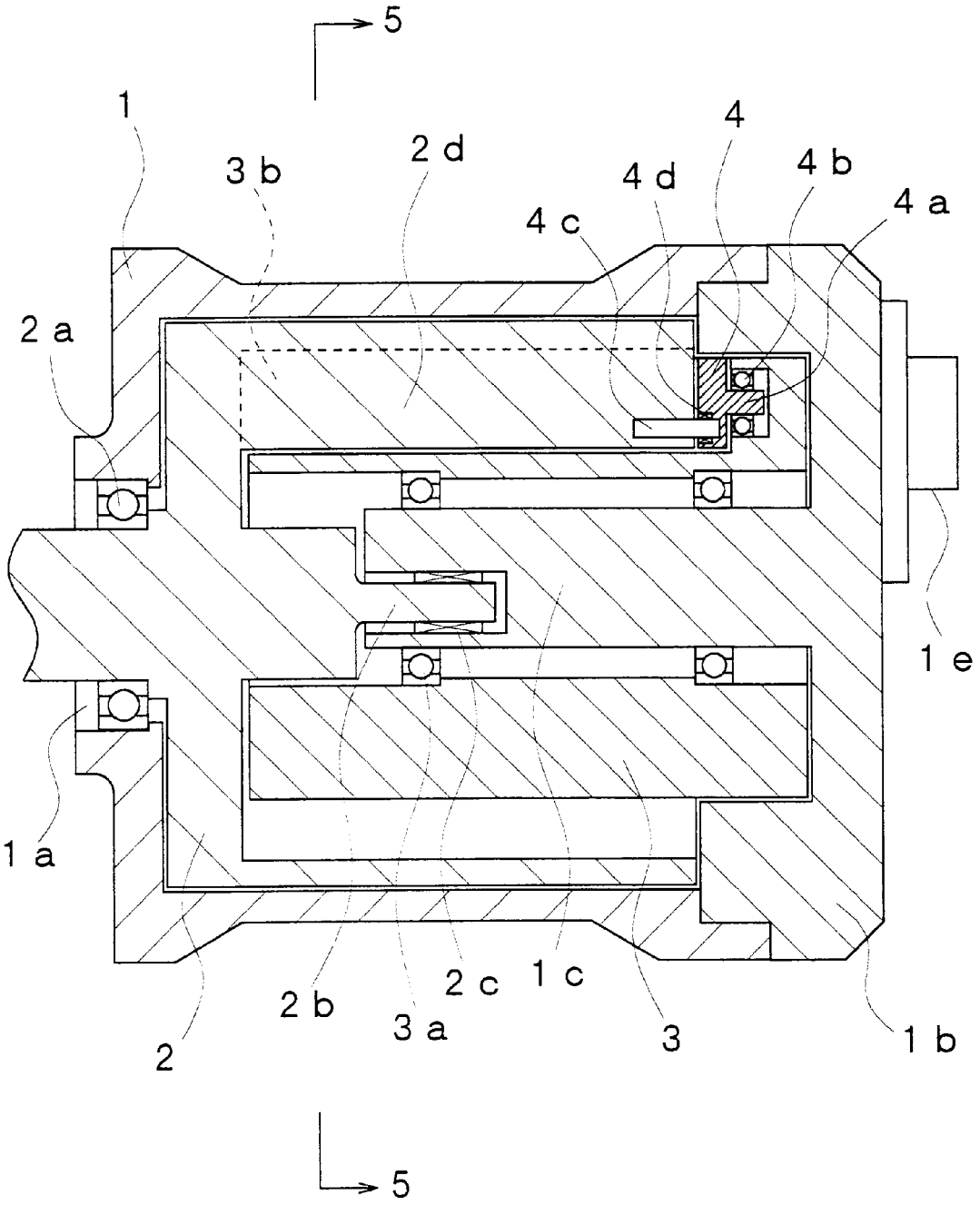
FIG. 1 is a sectional side elevation of a rotary compressor showing an embodiment of the present invention.
Figure 2:
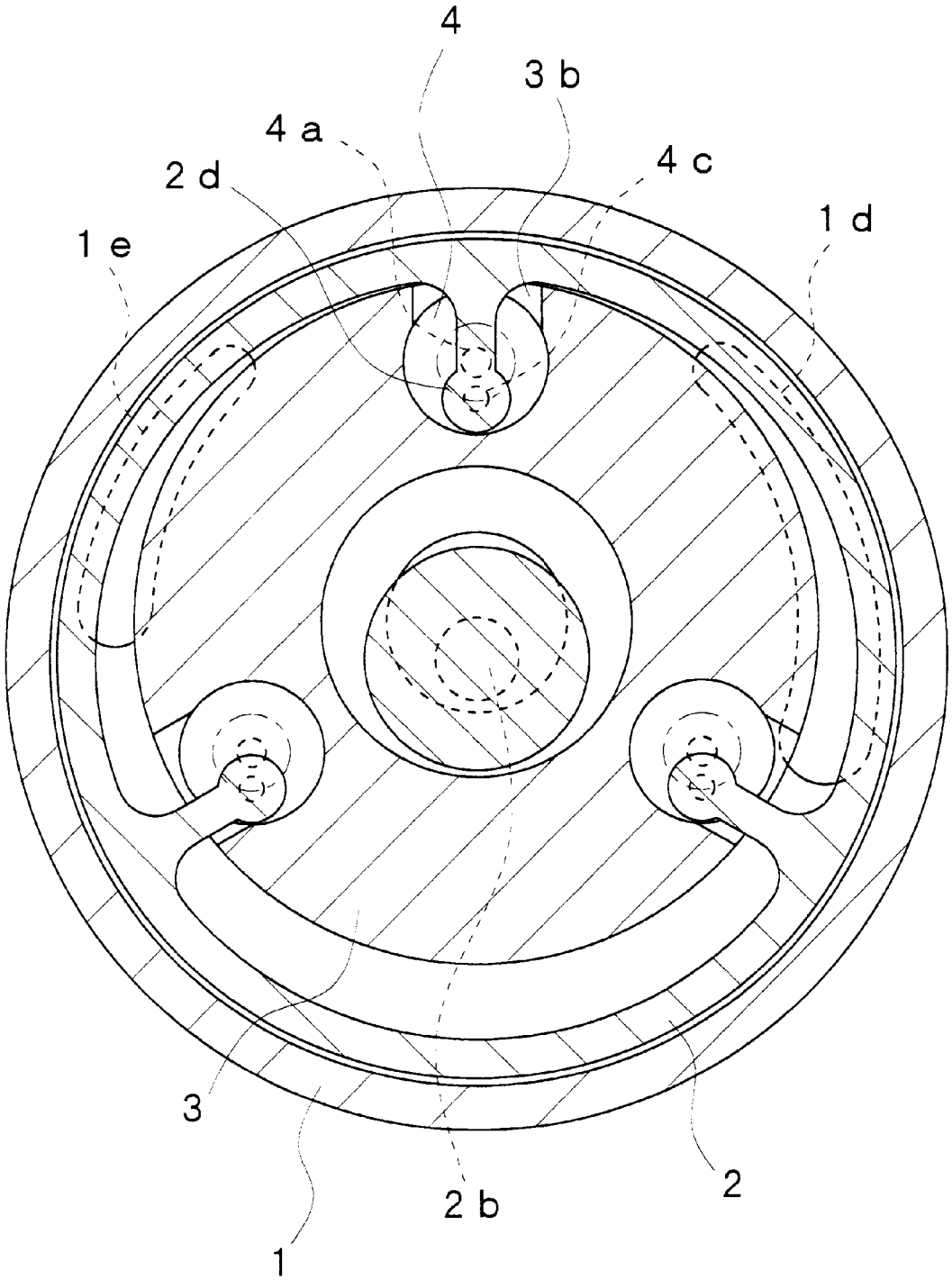
FIG. 2 is a sectional view taken along a line 5—5 of FIG. 1.
Figure 3:
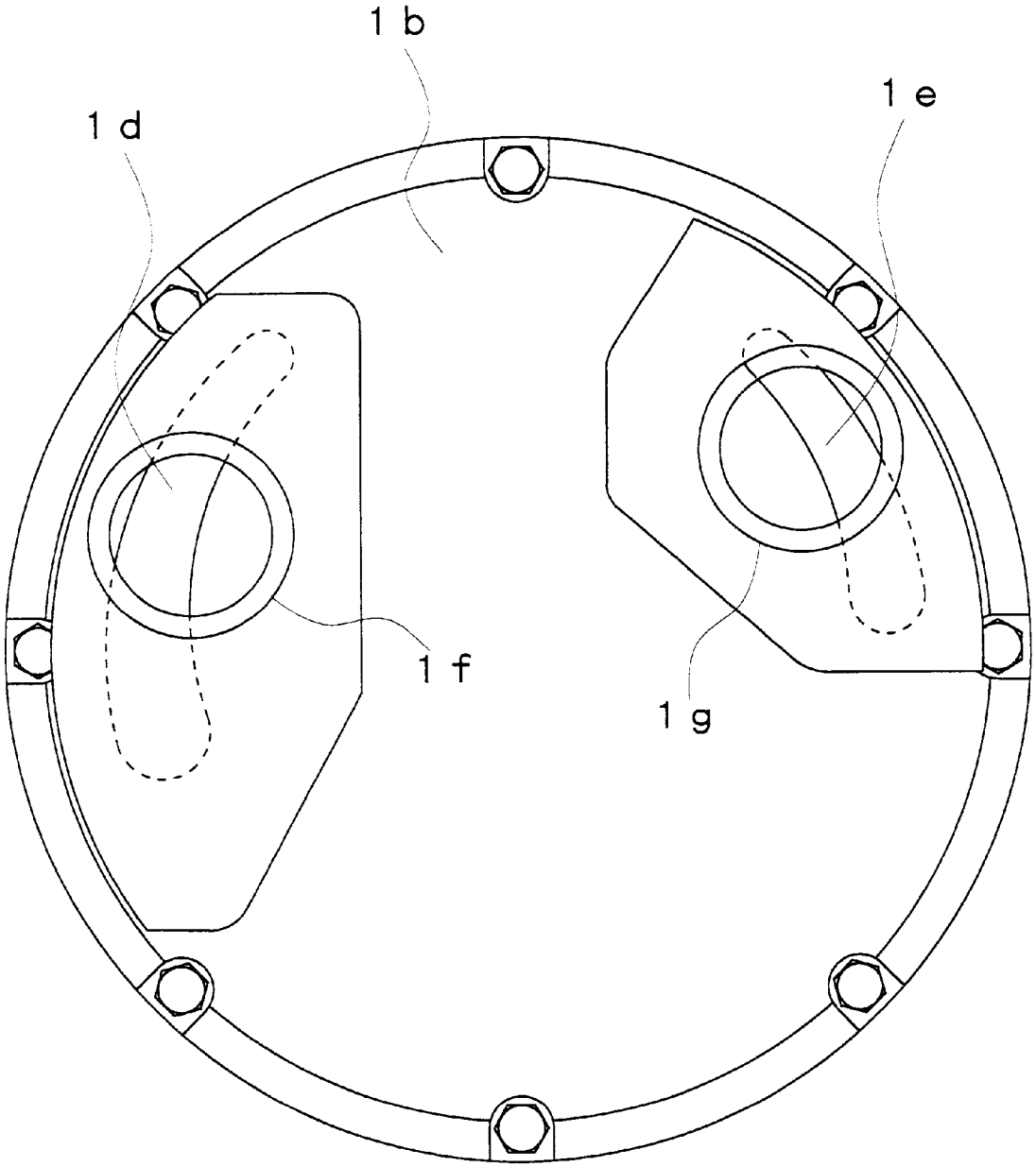
FIG. 3 is a front elevational view of the rotary compressor.
Figure 4:
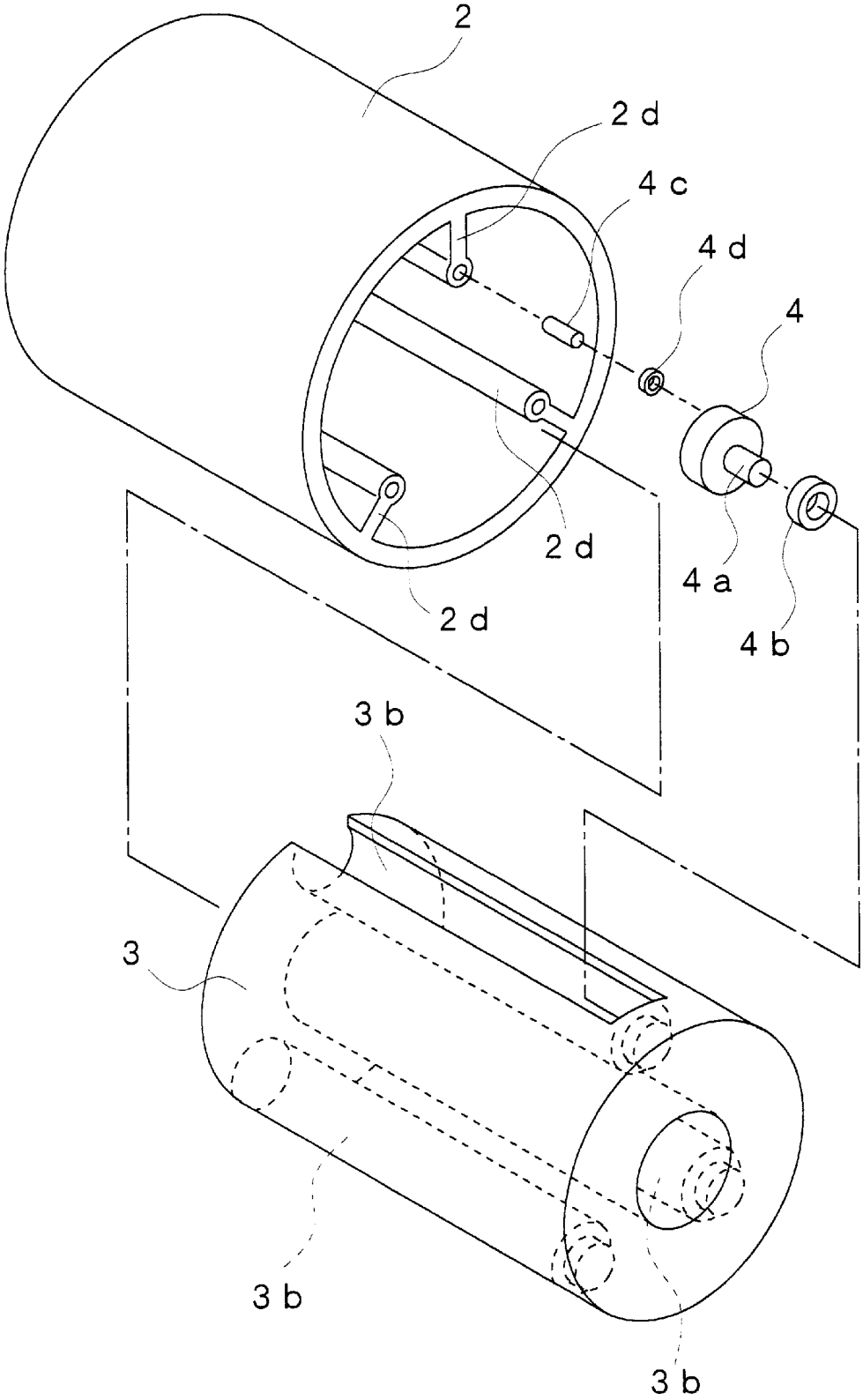
FIG. 4 is an exploded perspective view of the major parts of the rotary compressor.

FIGS. 1 to 5 illustrate an embodiment of the present invention. A rotary compressor according to this embodiment comprises a casing 1 constituting a compressor body, an outer rotor 2 rotatably housed in the casing 1, an inner rotor 3 rotatably supported at an eccentric position within the outer rotor 2, and a plurality of connecting plates 4 connecting the outer rotor 2 and the inner rotor 3 in a freely turnable state relative to each other.

The casing 1 is in the form of a hollow cylinder having one end which is opened and the other end which is provided with a bearing portion 1*a* for supporting the outer rotor 2. The one end of the casing 1 is fitted with a casing cover 1*b* carrying a support shaft 1*c* for providing a support for the inner rotor 3. The case cover 1*b* includes an inflow port 1*d* and an outflow port 1*e* which open into the interior of the casing 1, the inflow 1*d* and outflow 1*e* ports being connected to the exterior by way of a suction pipe 1*f* and a discharge pipe 1*g*, respectively.

The outer rotor 2 is in the form of a hollow cylinder having one end which is opened and the other end at which the outer rotor 2 is rotatably supported via a bearing 2*a* by the bearing portion 1*a* of the casing 1. The outer rotor 2 has a support shaft 2*b* extending through its hollow and rotatably supported via a bearing 2*c* by the support shaft 1*c* of the casing cover 1*b*. In this instance, the support shaft 1*c* of the casing cover 1*b* is offset radially from the rotational center of the outer rotor 2. The outer rotor 2 has on its inner peripheral surface a plurality of radially inwardly extending partition pieces 2*d* which are circumferentially spaced apart from one another in the shape of protruding portions for partitioning, the tip of each partition piece 2*d* being circular in section.

The inner rotor 3 is in the form of a hollow cylinder having open opposed ends and has the inner peripheral surface supported via a bearing 3*a* by the support shaft 1*c* of the casing cover 1*b*. The outer peripheral surface of the inner rotor 3 is formed with a plurality of radial partition grooves 3*b* which are circumferentially spaced apart from one another in the shape of recessed portions for partitioning, with each partition groove 3*b* extending axially up to one end surface of the inner rotor 3. The interior of each partition groove 3*b* is of a circular section, with part of its peripheral surface extending up to the outer peripheral surface of the inner rotor 3.

Each of the connecting plates 4 is in the form of a disk having an outer diameter equal to the inner diameter of the partition grooves 3*b* in the inner rotor 3. Each plate 4 has at its one end a support shaft 4*a* rotatably connected via a bearing 4*b* to the interior of each partition groove 3*b* on the other end side thereof. Each plate 4 has at its other end a pin 4*c* connecting to each partition piece 2*d* of the outer rotor 2 and rotatably supported by a bearing 4*d,* with the pin 4*c* being disposed on a predetermined circle around the support shaft 4*a*. Thus, rotations of the connecting plates 4 result in circular movements of the tips of the partition pieces 2*d* within the associated partition grooves 3*b* along the inner surfaces of the partition grooves 3*b* in a non-contact manner. In this instance, extremely minute gaps are kept between the partition pieces 2*d* and the associated partition grooves 3*b*.

Figure 5:
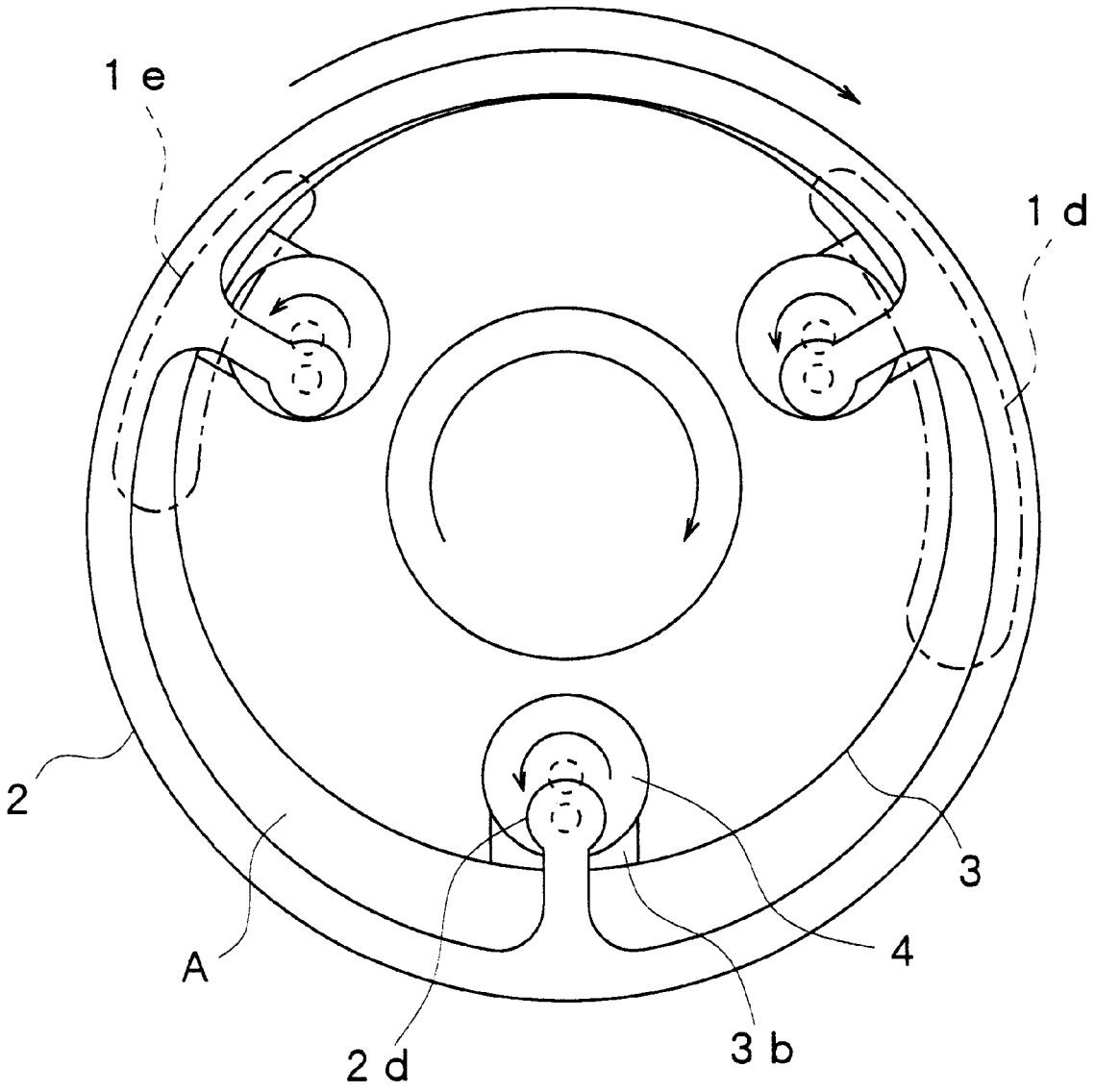
FIG. 5 is an explanatory diagram of the action of the rotary compressor.

In case of the thus constructed rotary compressor, when the outer rotor 2 is rotated by external rotational force, the inner rotor 3 also rotates together with the outer rotor 2 in the same direction since the outer rotor 2 is coupled via the connecting plates 4 to the inner rotor 3. At that time, the rotors 2 and 3 rotate at positions offset relative to each other, so that the partition pieces 2*d* of the outer rotor 2 describe a circle within the associated partition grooves 3*b* of the inner rotor 3 while turning the connecting plates 4. Thus, as shown in FIG. 5, the rotors 2 and 3 rotate together, with at least two partition pieces 2*d* turning all the time along the inner surfaces of the associated partition grooves 3*b* in a non-contact manner, so that a fluid from the inflow port Id flows into a space A between the rotors 2 and 3 partitioned by the partition pieces 2*d* and the partition grooves 3*b,* the fluid being finally discharged through the outflow port 1*e*.

Thus, according to the rotary compressor of this embodiment having a structure in which a fluid is sucked into and discharged from the space between the outer rotor 2 and the inner rotor 3 which rotate at positions offset relative to each other, the plurality of partition pieces 2*d* formed on the inner peripheral surface of the outer rotor 2 are caused to perform circular movement in a non-contact manner along the inner surfaces of the plurality of partition grooves 3*b* formed in the outer peripheral surface of the inner rotor 3 so that the space between the rotors 2 and 3 can be partitioned without allowing the partition pieces 2*d* and the partition grooves 3*b* to come into contact with one another, thereby making it possible to remarkably reduce the loss arising from mechanical friction and to deal with the use in high-speed rotations. Furthermore, the outer rotor 2 and the inner rotor 3 are coupled together by means of the connecting plates 4 so that the rotations of the connecting plates 4 allow circular movement of the partition pieces 2*d* of the outer rotor 2 along the inner surfaces of the partition grooves 3*b* of the inner rotor 3, with the result that application of rotational force to the outer rotor 2 can cause a rotation of the inner rotor 3.

Although the above embodiment is provided with a plurality of partition pieces 2*d* and a plurality of partition grooves 3*b,* it may have a single partition piece 2*d* and a single partition groove 3*b*.

Figure 6:
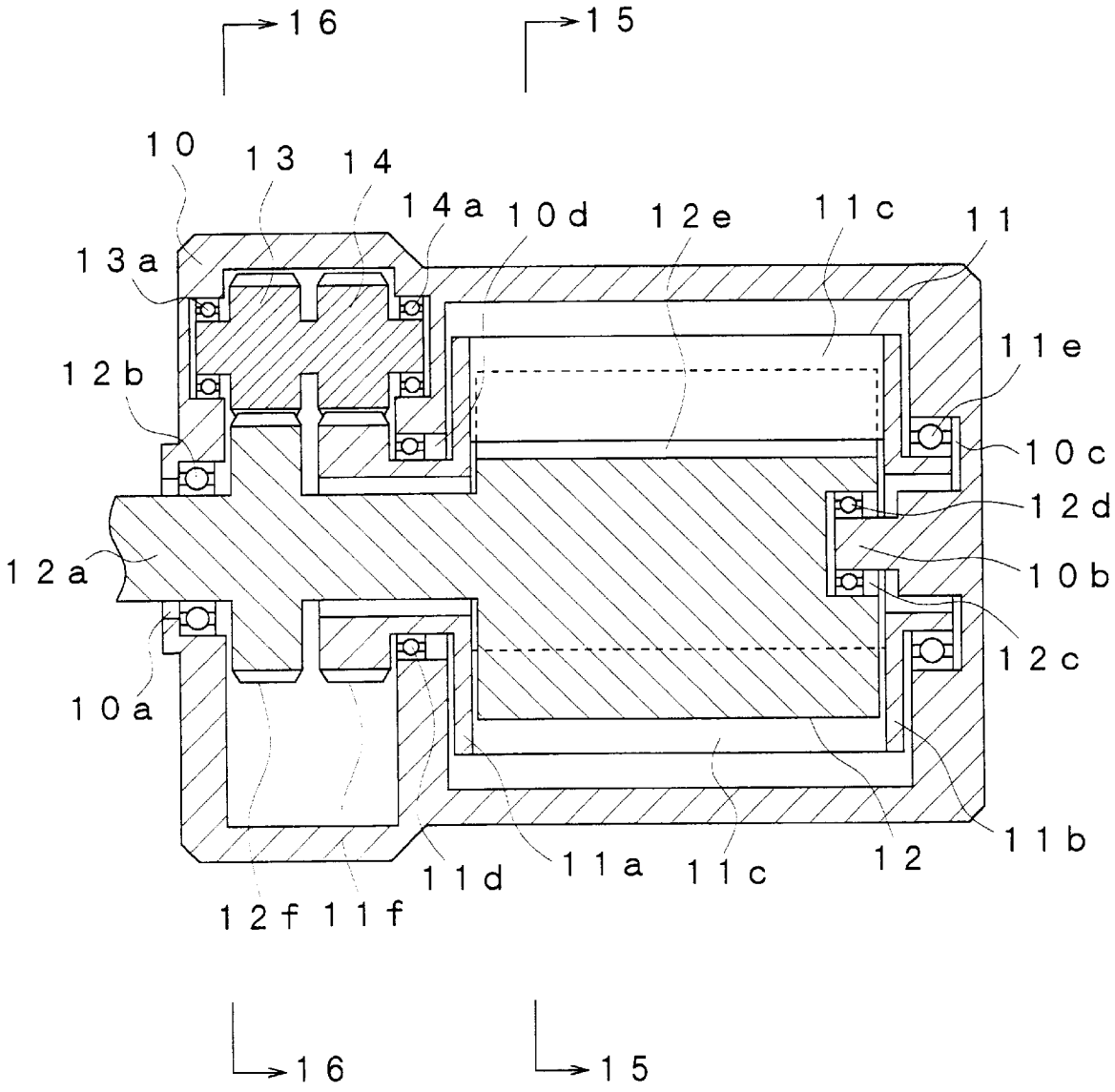
FIG. 6 is a sectional plan view of a rotary compressor showing another embodiment of the present invention.
Figure 7:
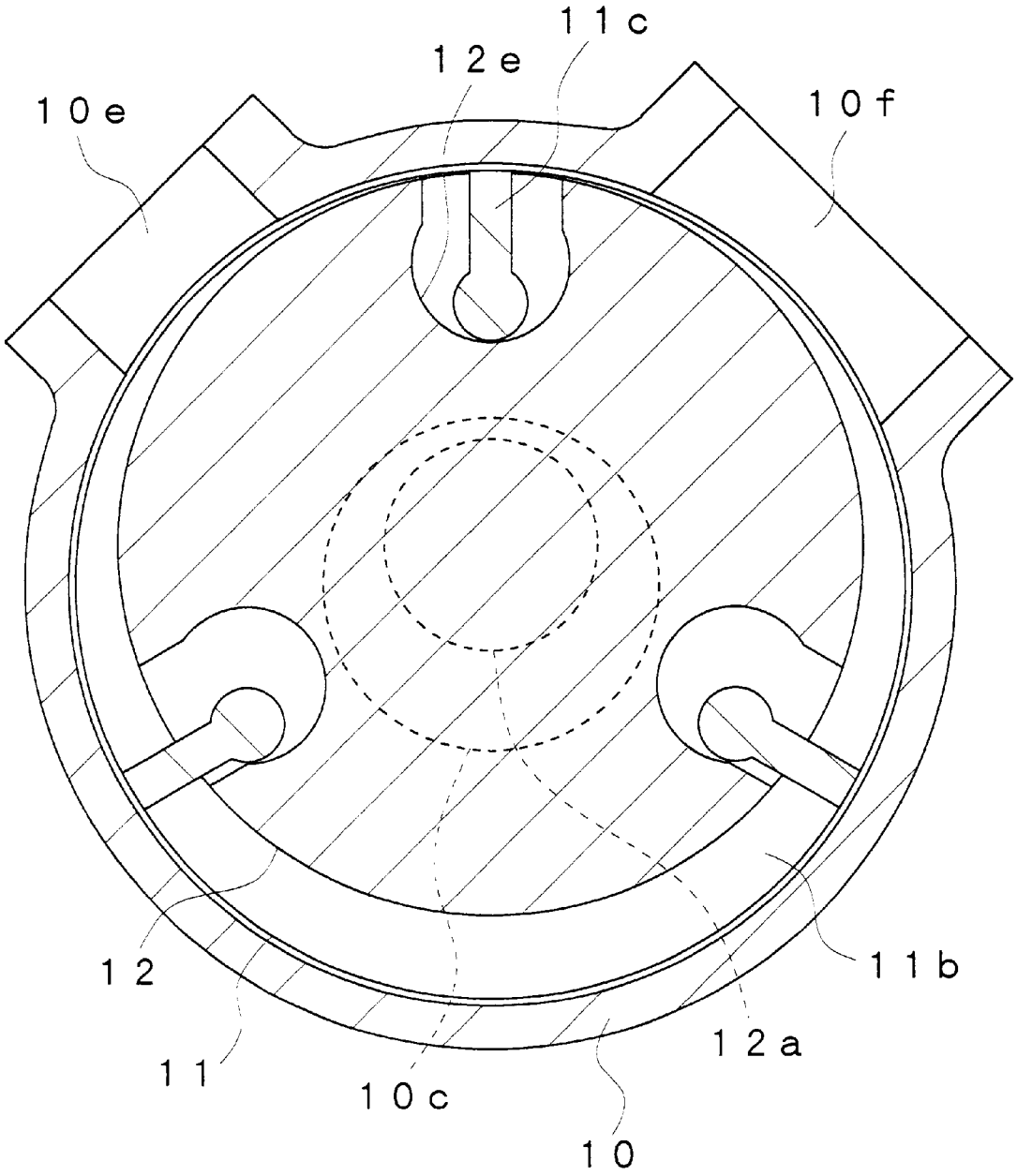
FIG. 7 is a sectional view taken along a line 15—15 of FIG. 6.
Figure 8:
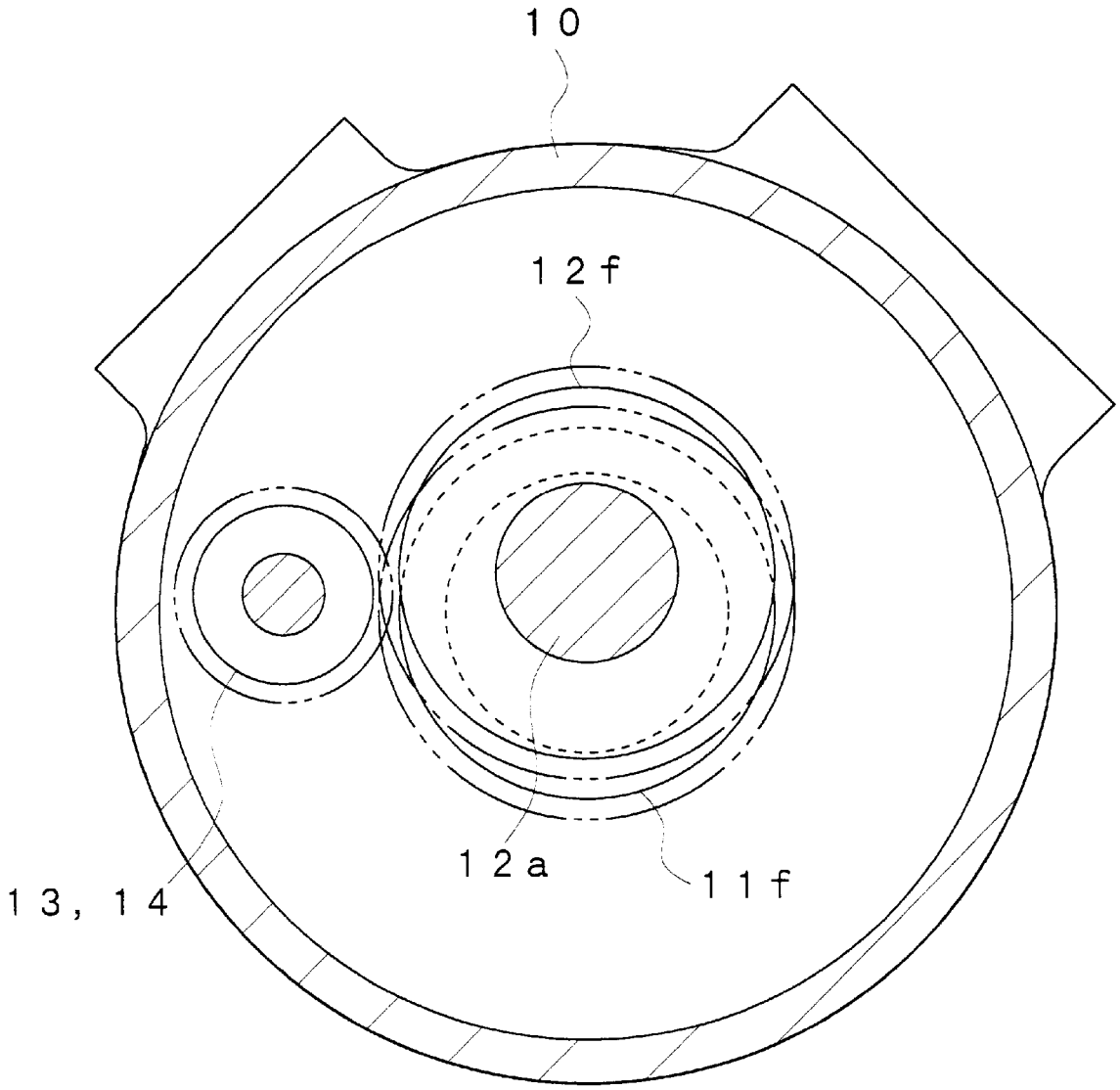
FIG. 8 is a sectional view taken along a line 16—16 of FIG. 6.

FIGS. 6 to 8 illustrate another embodiment of the present invention. A rotary compressor according to this embodiment comprises a casing 10 constituting a compressor body, an outer rotor 11 rotatably housed in the casing 10, an inner rotor 12 rotatably supported at an eccentric position within the outer rotor 11, and a pair of gears 13 and 14 for interlocking the outer rotor 11 and the inner rotor 12.

The casing 10 includes a bearing portion 10*a* and a support shaft 10*b* arranged at one end and the other end thereof, respectively, for providing a support for the inner rotor 12, and includes bearing portions 10*c* and 10*d* arranged at the other end thereof and internally at substantially the middle position, respectively, for providing a support for the outer rotor 11. The casing 10 further includes in its peripheral surface an inwardly opened inflow port 10*e* and outflow port 10*f* which are circumferentially spaced apart from each other.

The outer rotor 11 is provided with one end 11*a* and the other end 11*b* which are disk-shaped and axially confront each other, and with a plurality of partition pieces 11*c* in the shape of protruding portions for partitioning which extend between the one end 11*a* and the other end 11*b* and are circumferentially spaced apart from one another. The one end 11*a* of the outer rotor 11 is rotatably supported via a bearing 11*d* by the bearing portion 10*d* of the casing 10, the other end 11*b* being rotatably supported via a bearing 11*e* by the bearing portion 10*c* of the casing 10. The plurality of partition pieces 11*c* are inwardly raised from the inner peripheral surface of the outer rotor 11, with their tips being circular in section. A gear 11*f* is provided on the outer rotor 11 at the side of its one end 11*a*.

The inner rotor 12 has at its one end a support shaft 12*a* which is rotatably supported via a bearing 12*b* by the bearing portion 10*a* of the casing 10. The inner rotor 12 has at its other end a bearing portion 12*c* which is rotatably supported via a bearing 12*d* on the support shaft 10*b* of the casing 10. In this instance, the inner rotor 12 is supported to be radially offset from the rotational center of the outer rotor 11. The outer peripheral surface of the inner rotor 12 is formed with a plurality of partition grooves 12*e* which are radially recessed for partitioning and are circumferentially spaced apart from one another, the interior of each partition groove 12*e* being of a circular section. A gear 12*f* is provided on the support shaft 12*a* of the inner rotor 12. In this instance, the support shaft 12*a* of the inner rotor 12 extends through the one end 11*a* of the outer rotor 11, with the gear 12*f* of the inner rotor 12 being coaxial with the gear 11*f* of the outer rotor 11.

Gears 13 and 14 are provided axially integrally with each other, with the both ends thereof being rotatably supported via bearings 13*a* and 14*a,* respectively, within the casing 10. That is, the gears 13 and 14 mesh with the gear 11*f* of the outer rotor 11 and the gear 12*f* of the inner rotor 12, respectively, so that the outer rotor 11 and the inner rotor 12 are rotated by way of the gears 13 and 14, respectively. In this instance, the outer rotor 11 and the inner rotor 12 are designed to have the same speed reduction ratio. That is, arrangement is such that rotations of the outer rotor 11 and the inner rotor 12 cause circular movement of the tips of the partition pieces 11*c* within the partition grooves 12*e* while being in close proximity to the inner surfaces of the partition grooves 12*e*. In this instance, an extremely minute gap is secured between the partition pieces 11*c* and the partition grooves 12*e*.

According to the thus constructed rotary compressor, when the inner rotor 12 is rotated by external rotational force, the outer rotor 11 can rotate in the same direction together with the inner rotor 12 since the outer rotor 11 is coupled via the gears 13 and 14 to the inner rotor 12. At that time, the rotors 11 and 12 rotate at positions offset relative to each other, so that the partition pieces 11*c* of the outer rotor 11 perform circular movement along the inner surfaces of the partition grooves 12*e* of the inner rotor 12 in a non-contact manner. Thus, in the same manner as the preceding embodiment, a fluid is sucked through the inflow port 10*e* of the casing 10 into the space between the rotors 11 and 12 partitioned by the partition pieces 11*c* and the partition grooves 12*e,* the fluid being finally discharged through the outflow port 10*f* to the exterior.

While the present invention has been described with relation to certain presently preferred embodiments, those skilled in this art will recognize other modifications of the present invention which will still fall in within the scope of the invention, as expressed in the accompanying claims.

What is claimed is:

1. A rotary compressor comprising a casing having an inflow port and an outflow port for a fluid which open on its inner surface, a cylindrical outer rotor rotatably housed in the casing, and a cylindrical inner rotor rotatably supported at an eccentric position within the outer rotor, said rotors being rotated in a predetermined direction to introduce a fluid from the inflow port into a space between the rotors, the fluid being discharged through the outflow port, wherein:

said outer rotor has an inner peripheral surface provided with at least one or more protruding portions for partitioning which are radially inwardly raised and are circumferentially spaced apart from one another;

said inner rotor has an outer peripheral surface provided with at least one or more recessed portions for partitioning which are radially inwardly recessed and are circumferentially spaced apart from one another; and said outer rotor and said inner rotor are connected to each other in such a manner that said protruding portions for partitioning of said outer rotor move circularly in a non-contact manner along inner surfaces of said recessed portions for partitioning of said inner rotor.

2. The rotary compressor according to claim 1, further comprising:

at least one or more connecting members for rotatably connecting the ends of said protruding portions for partitioning of said outer rotor to the ends of said recessed portions for partitioning of said inner rotor.

3. The rotary compressor according to claim 1, further comprising:

gears for interlocking said outer rotor and said inner rotor.

4. The rotary compressor according to claim 1, wherein:

said inflow port and said outflow port for a fluid are provided on an end surface of said casing.

5. The rotary compressor according to claim 1, wherein:

said inflow port and said outflow port for a fluid are provided on a peripheral surface of said casing.

* * * * *